United States Patent [19]

Adams

[11] 3,990,375

[45] Nov. 9, 1976

[54] DETACHABLE SPOOL HOLDER FOR SEWING MACHINES

[75] Inventor: Kenneth D. Adams, Madison, N.J.

[73] Assignee: The Singer Company, New York, N.Y.

[22] Filed: Nov. 7, 1975

[21] Appl. No.: 629,834

[52] U.S. Cl. ..... 112/258; 248/223; 403/353

[51] Int. Cl.[2] ..... D05B 43/00

[58] Field of Search ..... 242/131, 130, 134, 136; 403/353; 112/257, 258; 223/106, 107, 108; 248/223

[56] References Cited

UNITED STATES PATENTS

| | | | |
|---|---|---|---|
| 988,837 | 4/1911 | Tharp | 242/136 X |
| 1,034,832 | 8/1912 | Plaatje | 242/136 |
| 3,066,902 | 12/1962 | Conil | 248/223 |
| 3,444,833 | 5/1969 | Blackwood et al. | 112/218 R |
| 3,587,587 | 6/1971 | Raskin | 242/136 |
| 3,845,927 | 11/1974 | Bratschi | 248/223 |

*Primary Examiner*—Werner H. Schroeder
*Assistant Examiner*—Conrad L. Berman
*Attorney, Agent, or Firm*—Edward L. Bell; Robert E. Smith; Julian Falk

[57] ABSTRACT

This disclosure relates to spool holders for supporting a spool of thread on a sewing machine and particularly relates to a detachable spool holder having spaced depending leg-like portions formed of resilient material for insertion into associated spaced apertures in the cover of the sewing machine so that the spool holder may be readily assembled onto the sewing machine frame and held in relatively tight fitting relationship therein while giving the appearance of a unitary structure.

4 Claims, 4 Drawing Figures

Fig. 1
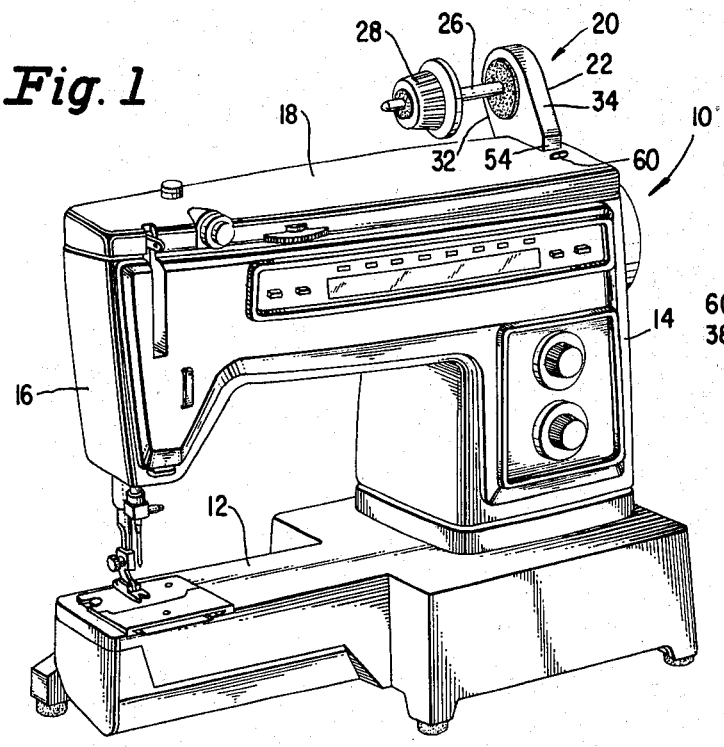
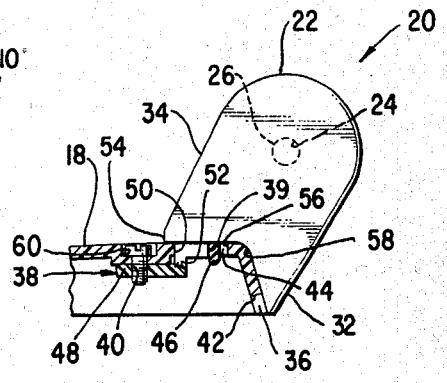
Fig. 3
Fig. 2
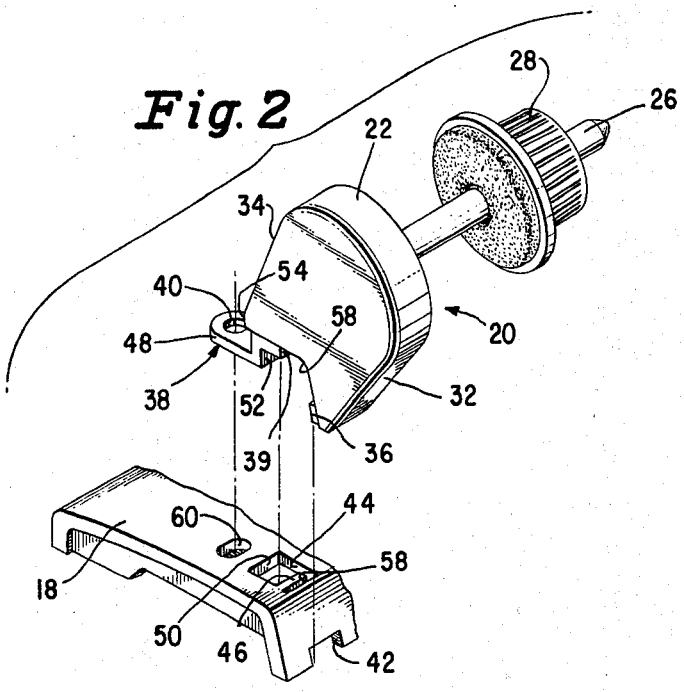
Fig. 4
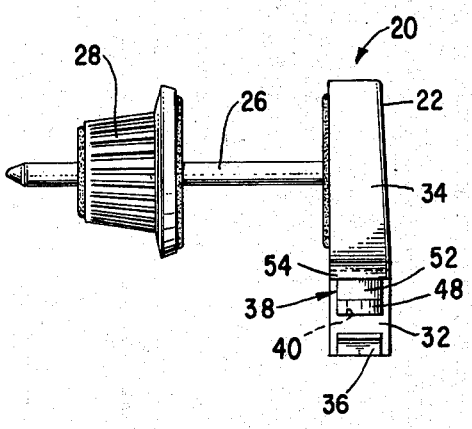

DETACHABLE SPOOL HOLDER FOR SEWING MACHINES

BACKGROUND OF THE INVENTION

It is known in the sewing machine art to provide a spool holder for a spool of thread on the frame of the sewing machine so that a supply of thread will be readily available to the operator. It is also known in the art to provide spool holders on the frames of sewing machines which are adjustable to various positions so that they do not protrude from the frame when the machine is folded and stored into a cabinet or the like. Such a spool holder is clearly illustrated in U.S. Pat. No. 3,444,833. In order to provide for relatively interference free flow of the thread from the spool holder through the various thread guides and ultimately to the needle, spool holders generally protrude away from the frame and cover of the machine so as to provide a minimum of interference with the flow of the thread therefrom. Also, supporting the spool holder away from the frame and cover enables the operator to have relatively easy access thereto for replacing the spool of thread on the spool holder when necessary. However, when spool holders are mounted on the sewing machine cover so as to protrude therefrom, it does present a problem when the machine is packed for shipping or when it is intended to be placed in a stored position in a sewing machine cabinet or the like. Unless the packer or the operator is careful when packing or moving the machine from one position to another there is a possibility that a protruding spool holder may be damaged or may be broken off from its supporting mechanism on the sewing machine cover. Further, since spool holders in themselves are of relatively lightweight construction, when machines incorporating a spool holder are packed for shipping there is a possibility due to rough handling during transit that such spool holders may be broken. It is a purpose of the present invention to overcome some of these problems.

GENERAL DESCRIPTION OF THE INVENTION AND DRAWINGS

In accordance with the present invention a spool holder for holding a spool of thread thereon is provided which is relatively readily detachable from the cover of the sewing machine so as to permit the machine to be shipped or stored with the spool holder disassembled from the machine while permitting relatively easy assembly when desired. The spool holder itself is formed of a relatively resilient material such as plastic or the like and has depending leg-like portions extending from the body portion thereof. At least one of the leg portions may be deformable so that it may be bent from its original position for insertion into one of the spaced apertures in the cover plate of the sewing machine frame and then released so that the leg will attempt to return to its original position after insertion and thereby bear against the walls of the cover plate to maintain the spool holder within the aperture means in a relatively tight fitting relationship. Because of the construction of the invention the spool holder may be detached from the sewing machine when packed for shipping and be relatively easily assembled when the machine is removed from its packing at its destination. Therefore, there will be little danger of the spool holder being broken off from the machine cover during shipping or storage of the machine. Further, because the spool holder will be in a detached condition, the packing of the sewing machine and the detached spool holder need not be as critical in the region of the spool holder position on the frame as would be if the spool holder were attached, thereby resulting in a cost savings. It will be further seen from the following detailed description that the spool holder is also constructed so that when it is supported on the machine cover plate the contour of the mating surfaces between the spool holder and the machine cover plate are substantially coincident so that when in assembled condition the spool holder would appear as though it were a unitary part of the cover plate. This obviously enhances the overall aesthetic appeal of the machine since it minimizes any broken or unsightly lines in the overall appearance of the machine.

Accordingly, it is one object of the invention to provide a novel and improved spool holder for a sewing machine.

It is another object of the invention to provide a novel and improved detachable spool holder for a sewing machine.

It is a further object of the invention to provide a novel and improved spool holder for a sewing machine, which when in assembled condition, has mating surfaces with the sewing machine cover plate which substantially conform thereto.

Other objects and advantages of the invention will be best understood when reading the following detailed description of a preferred embodiment of the invention with the accompanying drawings wherein:

FIG. 1 is a perspective view of a sewing machine embodying the present invention;

FIG. 2 is an enlarged exploded view of a portion of the sewing machine frame and a spool holder of the invention;

FIG. 3 is an end view of the spool holder of the invention; and

FIG. 4 is a front view of the spool holder of the invention.

DESCRIPTION OF PREFERRED EMBODIMENT

Referring to FIG. 1 of the drawings, there is shown therein a sewing machine having a frame 10 including a bed 12, a standard 14 extending upwardly from the bed 12 and a bracket arm 16 overhanging the bed 12. The machine also includes the usual reciprocating needle and other sewing instrumentalities which form no part of the present invention and further description thereof is not necessary for an understanding of the present invention and these elements may be incorporated from any known sewing machine.

Supported on the bracket arm 16 by suitable means is a cover plate 18 which overlies the top portion of the frame and which may be of the detachable type or may be unitary with other portions of the frame of the machine. Supported on the cover plate 18 is a spool holder 20 including a body portion 22 having an aperture 24 therein for receiving an elongated thread spool supporting pin 26 therein. A retaining cap 28 is supported at the opposite end of the pin 26 for retaining a spool of thread on the pin 26 during the sewing operation in a known manner. As is well-known, the retaining cap 28 is readily removable from the pin 26 by sliding it off the end thereof so that a new spool of thread may be replaced on the pin 26 when necessary.

Extending from the body portion 22 of the spool holder 20 are depending leg-like portions 32 and 34, the leg portion 32 including a relatively small protruding leg portion 36 and the leg portion 34 including an S-shaped depending leg portion 38 thereon. The S-shaped leg portion 38 further includes a hole or aperture therein whose purpose will be more fully described hereinafter. With reference to FIG. 2, the cover plate 18 is provided with aperture means including spaced apertures 42 and 44. The aperture 42 is formed in a side wall of plate 18 and cooperates with and corresponds to the shape of the protruding leg portion 36 on the leg 32 so that the leg portion 36 will be received within the aperture 42 when the spool holder 20 is assembled on the machine. The aperture 44 has a substantially rectangular shape including a rib portion or finger-like portion 46 extending from one side wall towards the center thereof but terminating short of the opposite wall thereof.

As seen in FIGS. 2 and 3, the leg portion 38 extending from the leg portion 34 is S-shaped and is spaced slightly below the surface of its lowermost portion of the leg portion 34 to form a ledge-like area 39. When the spool holder is assembled with the leg 38 placed in the aperture 44, the relatively long leg portion 48 of the L-shaped leg portion 38 will be seated in the front portion 50 of the aperture 44 and underlie the cover 18 while the relatively short leg portion 52 of the leg portion 38 will abut the rib 46 at the ledge-like area 39 (FIG. 3) and the extending portion 54 of the leg portion 34 will seat itself over the top surface of the front portion 50 of the aperture 44 to provide a flush mounting at that point.

As briefly mentioned above, the spool holder 20 is preferably formed of a resilient material which may be an elastomeric material such as plastic or the like. One such material which may be used with the present invention is marketed under the name CYCOLAC "T" by the Marbon Chemical Company. The relative association between the leg portions 32 and 34 of the spool holder 20 and the apertures 42 and 44 in the cover plate 18 is such that it is preferable that the leg portion 32 and 34, or at least the S-shaped leg 38 be deformable so that the leg portion 38 may be bent or deformed for insertion into the associated aperture 44. With this feature, when the leg portion 38 is deformed and inserted into the aperture 44, upon its release it will tend to spring back to its original position so that upon assembly the spool holder will be forced into tight fitting engagement with the mating wall surfaces of the apertures 42 and 44. Preferably, only the leg portion 38 need be readily deformable.

A further feature of the invention lies in the shape or contour of the inner surface 58 of the spool holder 20 which lies between the leg portions 36 and 38. This inner surface 58 has a contour which substantially coincides with the contour of the cover plate in that region which underlies the spool pin holder when the spool pin holder is in the assembled condition. By this means, the surfaces between the cover plate 18 and the spool holder 20 which mate will appear to be substantially unitary, thus increasing the overall aesthetic appeal of the combination. As will be apparent, when the spool holder is assembled on the machine, becasue of this feature, a spool holder will not give the appearance that it is of the detachable type and will look or appear as a permanent part of the machine frame.

When it is desired to pack the machine for shipment, for example, the spool holder may be packed separately in the container apart from the machine. This will then eliminate what was an ever present possibility that the spool holder, if in an assembled condition, could be broken off from the frame of the machine due to mishandling or the like. When the machine is received at its final destination one need merely remove the machine from the container and separately remove the spool holder and, as explained above, grasp the leg portions thereof and snap the spool holder into position in the top cover of the machine. Because of the construction of the invention the assembly thereof is relatively easy and will result in a spool holder frame combination which gives the appearance of a unitary and aesthetic structure. If desired, when the spool holder 20 is assembled on the cover plate 18 a fastening means such as a screw or the like may be placed through the hole 60 in the top cover 18 of the frame and into the aperture 40 provided in the depending portion 48 of the S-shaped leg 38. Although such a fastening means is not necessary for purposes of the present invention, if a more rigid structure is desired such a fastening means may be used.

While the invention has been described in its preferred embodiment, it wil be obvious to those skilled in the art that various changes and modifications may be made therein without departing from the spirit and scope of the invention as defined in the appended claims.

Having thus described the nature of the invention, what we claim herein is:

1. In a sewing machine having a frame and spaced apertures in said frame for receiving a spool holder, a detachable spool holder for supporting a spool of thread on said frame, said spool holder including a spool holder body having a hole therein for receiving a spool pin, said body having depending legs extending therefrom, at least one of said legs being formed of a resilient material such that said leg is deformable and said leg having a shape for interlocking with a wall of said frame adjacent to an aperture receiving said leg and within the interior of said frame and said legs being spaced with respect to the spaced apertures in said frame such that when said legs are inserted into said spaced apertures they will engage the wall of said frame in a relatively tight fitting engagement for supporting said spool holder on said frame.

2. In a sewing machine as recited in claim 1 wherein the surface of said body between said legs has a shape conforming to the surface of said frame in the region wherein said body is adapted to be mounted on said frame.

3. In a sewing machine as recited in claim 1 wherein said body is formed from an elastomeric material.

4. In a sewing machine as recited in claim 1 further comprising fastening means for fastening at least one of said legs to said frame after insertion of said legs into said aperture means.

* * * * *